US005547398A

United States Patent [19]

Ichikawa et al.

[11] Patent Number: 5,547,398

[45] Date of Patent: Aug. 20, 1996

[54] SHIELDED ELECTRICAL CONNECTOR

[75] Inventors: Shouzou Ichikawa, Kawasaki; Naoya Matsuura, Yokohama, both of Japan

[73] Assignee: Molex Incorporated, Lisle, Ill.

[21] Appl. No.: 443,416

[22] Filed: May 22, 1995

[30] Foreign Application Priority Data

Feb. 23, 1995 [JP] Japan ..... 7-002129 U

[51] Int. Cl.[6] ..... H01R 13/648

[52] U.S. Cl. ..... 439/607

[58] Field of Search ..... 439/79, 607, 609, 439/610

[56] References Cited

U.S. PATENT DOCUMENTS

| | | | |
|---|---|---|---|
| D. 332,598 | 1/1993 | Kikuta et al. | D13/147 |
| 5,104,326 | 4/1992 | Smith et al. | 439/95 |
| 5,125,853 | 6/1992 | Hashiguchi | 439/607 |
| 5,147,220 | 9/1992 | Lybrand | 439/567 |
| 5,163,851 | 11/1992 | Hart et al. | 439/567 |
| 5,201,675 | 4/1993 | Igarashi et al. | 439/607 |
| 5,326,282 | 7/1994 | Igarashi et al. | 439/607 |
| 5,340,321 | 8/1994 | Hashiguchi et al. | 439/108 |
| 5,356,313 | 10/1994 | Niwa et al. | 439/607 |
| 5,401,189 | 3/1995 | Sato | 439/607 |

*Primary Examiner*—Khiem Nguyen
*Attorney, Agent, or Firm*—James C. Paschall

[57] ABSTRACT

An electrical connector includes a dielectric housing mounting a plurality of terminals. The housing has a front face and a mating portion projecting forwardly of the front face with contact portions of the terminals located on the mating portion. A conductive shield is disposed about at least a portion of the housing and includes a flange abutting the front face of the housing and a shroud surrounding the mating portion of the housing. Complementary interengaging retaining portions are provided between the housing and the shield to properly retain the shield on the housing, including a recess in the flange of the shield and a boss projecting forwardly from the front face of the housing into the recess.

19 Claims, 3 Drawing Sheets

SHIELDED ELECTRICAL CONNECTOR

FIELD OF THE INVENTION

This invention generally relates to the art of electrical connectors and, particularly, to a shielded electrical connector having means to prevent deformation of a metal shield.

BACKGROUND OF THE INVENTION

With the miniaturization of electronic appliances, it has become desireable to miniaturize electrical connectors. For example, right angle "D-shaped" electrical connectors are commonly used in the electronics industry as an input/output (I/O) device to interconnect various electronic appliances, such as interconnecting a computer to external peripheral equipment. The terminals of the electrical connector typically are soldered to conductive circuit traces on a printed circuit board, such as at a back wall or panel of the computer. A conductive shield surrounding the contacts in the housing of the connector frequently is used to protect against electromagnetic or radio frequency interference (EMI/RFI).

The housings of shielded I/O connectors, as described above, typically include a forwardly projecting mating portion in which the mating portions of the terminals are located and a rear section at which the solder tails are located. For instance, the forwardly projecting mating portion may be of a "D" configuration for the right angle "D-shaped" electrical connectors described above. The shield extends around the forwardly projecting mating portion and is secured to the housing immediately behind a front flange of the shield from which the forwardly projecting portion extends.

Heretofore, various means for securing the shield to the housing have been utilized, including having openings or windows on the shield into which projections on the housing extend generally transversely to the direction of elongation of the connector. Alternatively, the shield has projections or tabs that extend into openings in the housing. Because each of these means for retaining the shield typically utilize a significant amount of space they decrease the ability to miniaturize the connector. Some connectors have eliminated most of the members for retaining the shield on the housing, but this approach presents a potential problem as the shields continue to be manufactured of thinner metal in order to reduce costs and simplify their manufacturability. These thinner materials are more readily deformable and, thus, subject to damage if they are deflected in an undesirable manner during mating or assembly. For instance, the walls of the shield around the forwardly projecting mating portion are so thin that they have a tendency to open up or bend more easily, resulting in either damage to the shield or interference with mating of the connector with a complementary connecting device.

This invention is directed to solving the myriad of problems identified above and providing a very simple means of supporting the shield on the connector housing yet still permitting miniaturization of the housing.

SUMMARY OF THE INVENTION

An object, therefore, of the invention is to provide a new and improved shielded electrical connector of the character described, and including a new and improved means or system for supporting the shield on the connector housing.

In the exemplary embodiment of the invention, the connector includes a dielectric housing mounting a plurality of terminals. The housing has a front face and a mating portion projecting forwardly of the front face, with contact portions of the terminals located on the mating portion. A conductive shield is disposed about at least a portion of the housing and includes a flange abutting the front face of the housing. The shield includes a shroud surrounding the mating portion of the housing. Generally, complementary interengaging portions are provided between the housing and the shield to properly retain the shield on the housing. In particular, a recess is formed in the flange of the shield and a boss projects forwardly from the front face of the housing into the recess to prevent movement of the shield thereat. In this manner, the thickness or width of the connector housing does not have to be expanded in any way.

The mating portion of the housing is elongated to define long sides thereof, and the shroud of the shield has long side walls covering the long sides of the mating portion. The recess and the boss are located generally intermediate opposite ends of the long sides and long side walls.

As disclosed herein, the connector is a right-angle connector for mounting on a printed circuit board, with the mating portion of the connector housing projecting generally parallel to the board and the terminals projecting rearwardly of the housing. Right-angled tail portions of the terminals extend generally perpendicular to the board for connection to appropriate circuit traces thereon. The housing includes a relatively narrow elongated body portion defining a rear face opposite the front face and from which the terminals project. The right-angled tail portions are located in an array immediately adjacent the rear face of the housing.

Preferably, the dielectric housing is a one-piece molded structure with the retaining boss being integral therewith. The shield is a one-piece stamped and formed sheet metal structure with the recess being a notch in an outer edge of the flange of the shield or an opening through the flange.

Still further, the mating portion of the housing is elongated with ends of the housing projecting longitudinally beyond opposite ends of the mating portion. Latch tabs are provided on the shield for engaging latch bosses on the housing at locations longitudinally beyond the opposite ends of the mating portion and beyond the array of tail portions at the rear face of the housing. The latch tabs project rearwardly generally perpendicular to the flange of the shield.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
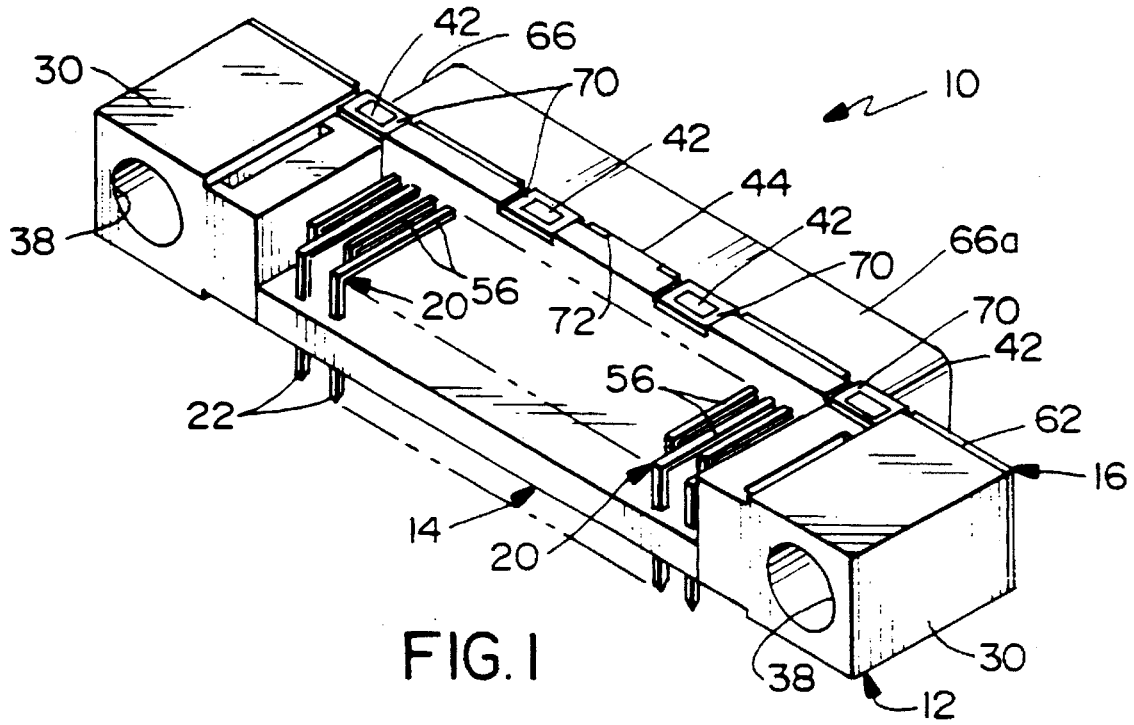
FIG. 1 is a top rear perspective view of an electrical connector embodying the concepts of the invention.
Figure 2:
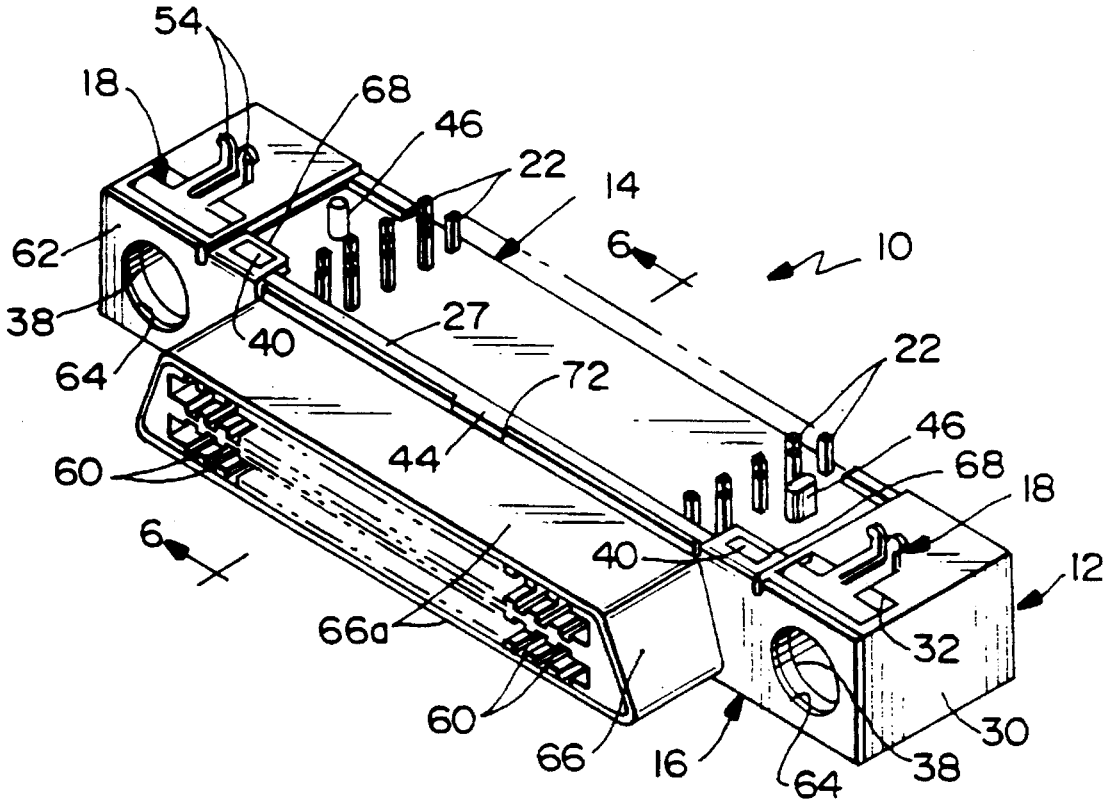
FIG. 2 is a bottom front perspective view of the connector.
Figure 3:
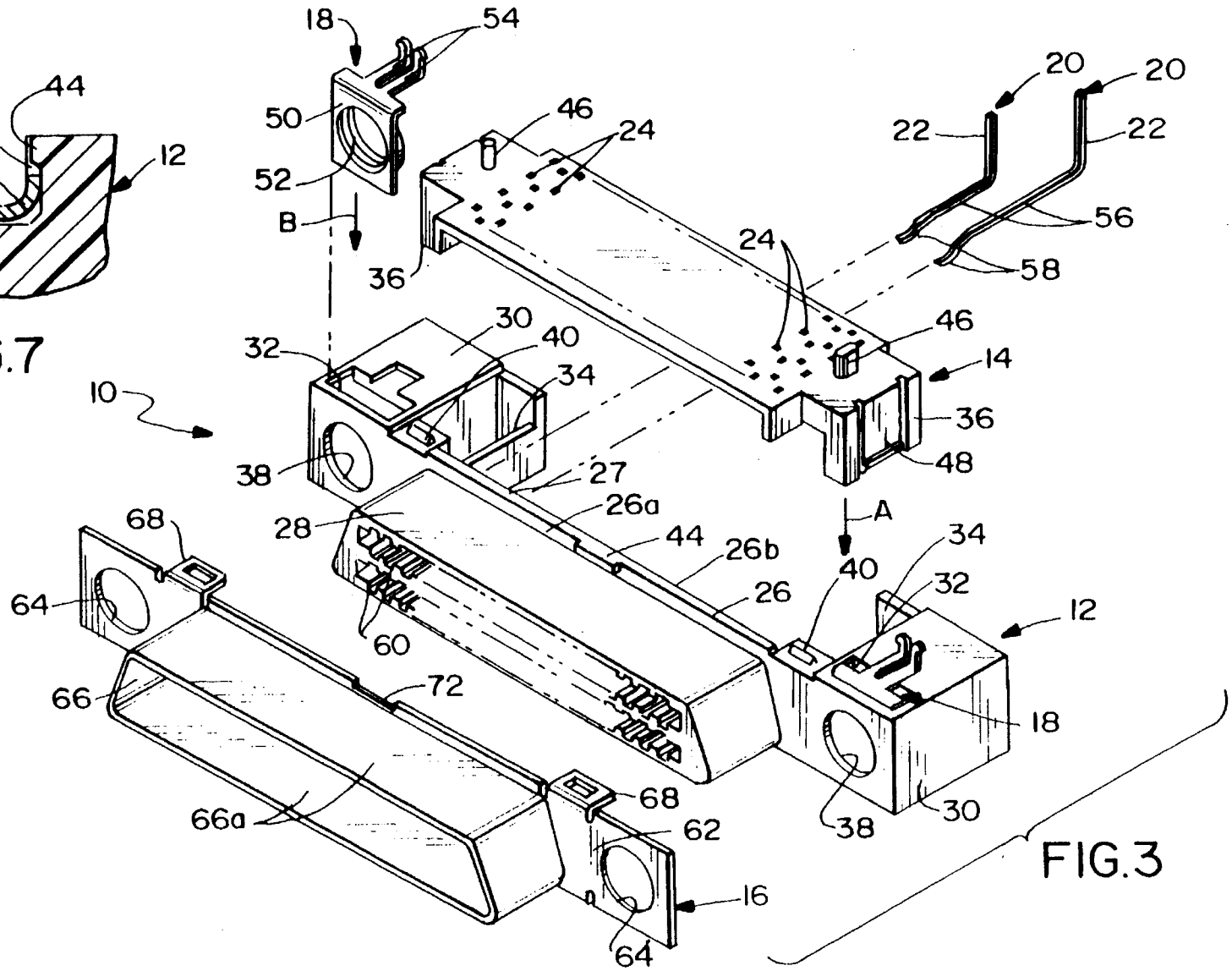
FIG. 3 is an exploded bottom perspective view of the connector as viewed from the front.

Referring to the drawings in greater detail, and first to FIGS. 1–3, the invention is embodied in an electrical connector, generally designated 10. The components of the connector are best seen in the exploded perspective view of FIG. 3. The components include a one-piece dielectric housing, generally designated 10, molded of plastic or like material. A terminal tail aligner, generally designated 14, is mounted on the housing. A one-piece stamped and formed sheet metal shield, generally designated 16, is mounted on the housing. A pair of boardlocks, generally designated 18, are mounted on the housing. Lastly, a plurality of right-angled terminals, generally designated 20, are mounted on the housing, with tail portions 22 projecting through holes 24 in tail aligner 14.

More particularly, housing 12 includes an elongated body portion 26 having a front face **26*a* and a rear face 26*b*. A mating portion 28 projects forwardly of front face 26*a* of body portion 26. It can be seen that the mating portion is of a "D" configuration commonly used in D-Shaped connectors. End or wing portions 30 of housing 12 project longitudinally beyond mating portion 28, with the front faces of the end portions forming a continuous flat surface with front face 26*a* of body portion 26. Vertical slots or passages 32 (FIG. 3) are formed in end portions 30 for receiving boardlocks 18. Additional vertical slots or passages 34 are formed in end portions 30 for receiving legs 36 (FIG. 3) of tail aligner 14. Through holes 38 are formed in end portions 30 for receiving appropriate mounting and guiding members for securing connector 10 to a complementary connecting device. A pair of shield retention latch bosses 40 project from the bottom edge of body portion 26 longitudinally beyond mating portion 28, and four additional latch bosses 42 (FIG. 1) project from the top edge of the body portion. Lastly, as best seen in FIGS. 2 and 3, a retaining boss 44 projects forwardly of front face 26*a* of body portion 26 intermediate the ends of mating portion 28** and immediately adjacent to the mating portion, both at the top and bottom of the mating portion.

Tail aligner 14 is a one-piece structure unitarily molded of dielectric material such as plastic or the like. As stated above, tail portions 22 of terminals 20 project through holes 24 in the tail aligner. This aligns and properly spaces the tail portions for insertion into appropriate holes in a printed circuit board. In addition, the tail aligner protects the tail portions during shipping of the connectors. A pair of integral mounting posts 46 project from the bottom of the tail aligner for insertion into appropriate mounting holes in the printed circuit board. It can be seen that the posts have different shapes or sizes to allow for polarization of the connector on the board. Legs 36 of the tail aligner have integral flexible latch arms 48 (FIG. 3) for latching the tail aligner to appropriate latch means (not visible in the drawings) within end portions 30 of connector housing 12, as legs 36 are inserted into passages 34 of the housing during assembly.

Each boardlock 18 includes a generally planar body portion 50 having a through hole 52 which aligns with the respective through hole 38 in end portion 30 of the housing as the boardlock is inserted into its respective passage 32 in the direction of arrow "B" (FIG. 3). The boardlocks are stamped and formed of sheet metal material, and, with the mounting and guiding members being of metal material, a grounding system is afforded through the boardlocks and a pair of mounting legs 54 of each boardlock which lock into appropriate mounting holes in the printed circuit board. The mounting legs can be soldered to ground traces on the printed circuit board.

Terminals 20 have body portions 56 which project through body portion 26 of housing 12 and into mating portion 28 of the housing. The body portions 56 terminate in contact portions 58 of the terminals which are located in troughs or channels 60 within forwardly projecting mating portion 28.

Shield 16 is a one-piece structure stamped and formed of sheet metal material. The shroud 66 is drawn from flange 62 as is known in the art. Therefore, the shield is conductive to provide further grounding means for the connector as well as to provide EMI/RFI protection for the contact portions of the terminals within mating portion 28 of housing 12. More particularly, the shield includes a flange 62 which abuts against front face 26a of body portion 26 and the front surfaces of end portions 30 of connector housing 12. The ends of the flange have through holes 64 which are alignable with holes 38 in the housing and holes 52 of boardlocks 18 for receiving the conductive mounting bolts. A D-shaped shroud 66 projects forwardly of flange 62 for generally surrounding or encircling mating portion 28 of the housing and the contact portions therewithin. Like body portion 26 and mating portion 28 of the housing, shroud 66 is elongated and defines a pair of long side walls 66a. A pair of apertured latch tabs 68 project rearwardly from the bottom edge of flange 62 for snapping interengagement with latch bosses 40 on the bottom of connector housing 12. In addition, four apertured latch tabs 70 (FIG. 1) project rearwardly from the top edge of flange 62 for snapping interengagement with latch bosses 42 on the bottom of connector housing 12. Lastly, a recess in the form of a notch 72 (FIG. 3) is formed in each of the top and bottom edges of flange 62 intermediate the ends of side walls **66*a* of shroud 66. These recesses receive retaining bosses 44 projecting forwardly from front face 26*a* of body portion 26** of the connector housing.

Figure 7:
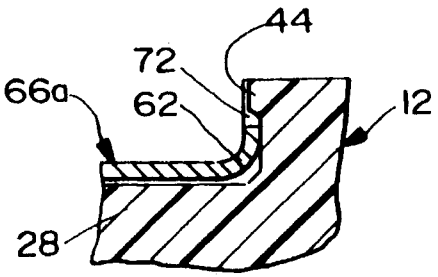
FIG. 7 is a vertical section taken generally along line 7—7 of FIG. 5.
Figure 4:
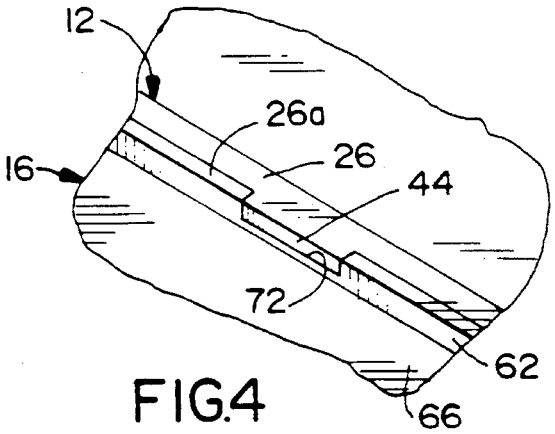
FIG. 4 is a perspective view, on an enlarged scale, of the complementary interengaging retaining means between the shield and the housing of the connector.
Figure 5:
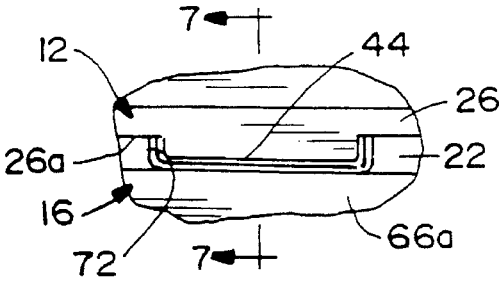
FIG. 5 is a front elevational view of the retaining means shown in FIG. 4.

FIGS. 4, 5 and 7 show in greater detail how retaining bosses 44 project forwardly of front face **26*a* of body portion 26 of the connector housing into recesses or notches 72 in the top and bottom edges of flange 62 of shield 16. It can be seen that the boss need only project a small distance, i.e., approximately the thickness of the sheet metal of the flange. This clearly shows that the overall dimensions of the connector housing and the connector itself, do not have to be enlarged to accommodate the complementary interengaging retaining means provided by bosses 44 and recesses 72**.

Figure 6:
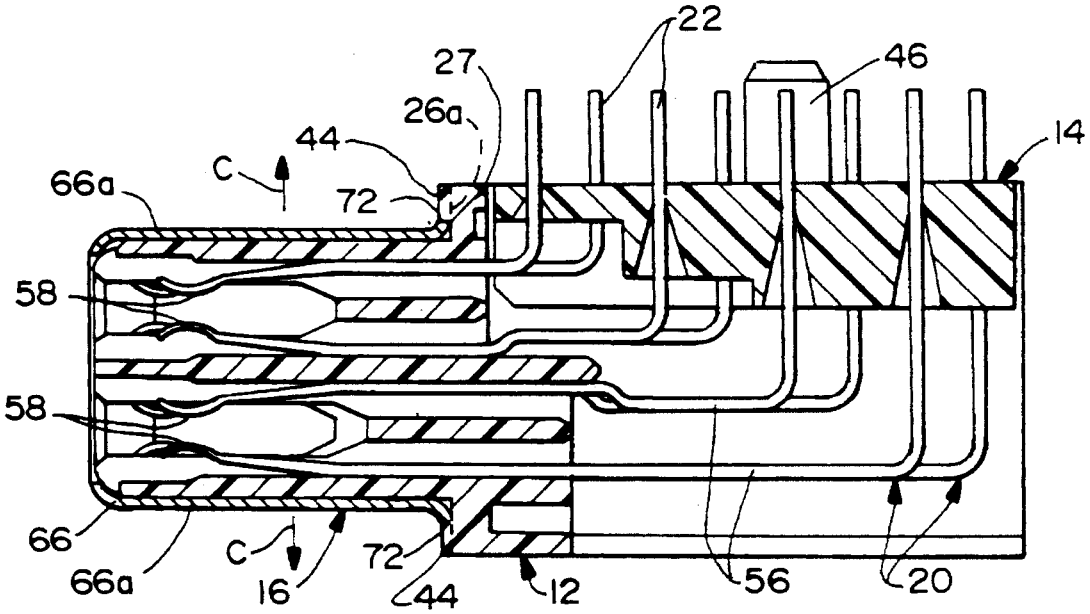
FIG. 6 is a vertical section, on an enlarged scale, taken generally along line 6—6 of FIG. 2.

FIG. 6 shows in detail how retaining bosses 44 project forwardly of front face 26a of body portion 26 of the housing into recesses 72 in flange 62 of the shield. Therefore, it can be understood that the thin metal side walls **66*a* of shroud 66 of the shield cannot spread apart or bend in the direction of arrows "C" because of the interengagement of retaining bosses 44 of the housing within recesses 72 of the shield. This depiction also shows that the bosses do not need to project forwardly of front face 26***a* of the housing beyond the thickness of flange 62 of the shield. As best seen in FIGS. 2, 3 and 6, by utilizing retaining boss 44 and recess 72 on the bottom of the housing, the lower portion 27 of housing body 26 may be extremely thin in a direction transverse to the housing. This permits reduction of the distance between body 26 and the shortest terminals or those whose tails 22 are closest to body 26. This reduction in distance between the shortest terminals and body 26 likewise reduces the overall lateral depth of the connector which means it requires less "real estate" on a circuit board.

Figure 8:
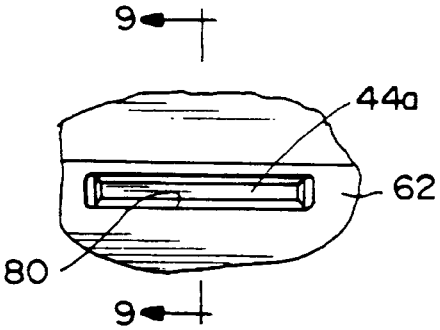
FIG. 8 is a view similar to that of FIG. 5, but of an alternate embodiment of the invention.
Figure 9:
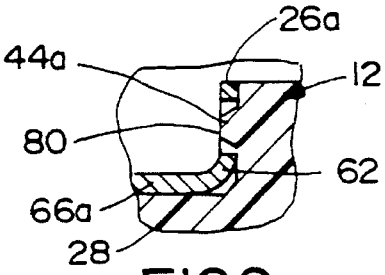
FIG. 9 is a vertical section taken generally along line 9—9 of FIG. 8.

FIGS. 7 and 8 show an alternate embodiment of the invention wherein retaining bosses 44*a* are spaced from the top and bottom surfaces of the connector and project forwardly of front face 26*a* of housing 12 into apertures 80 (rather than notches 72) in flange 62 of the shield. Again, the bosses do not have to project more than the thickness of the sheet metal material of the flange.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a housing molded of dielectric material mounting a plurality of terminals, the housing having a front face and a mating portion projecting forwardly of the front face with contact portions of the terminals located on the mating portion;

a conductive shield about at least a portion of the housing and including a flange abutting the front face of the housing and a shroud generally encircling the mating portion of the housing; and complementary interengaging retaining means between the housing and the shield to properly retain the shield on the housing and including a recess in the flange of the shield and a boss formed integrally with said housing, said boss projecting forwardly from the front face of the housing into the recess.

2. The electrical connector of claim 1 wherein said shield is a one-piece stamped and formed sheet metal structure with said recess being formed in said flange.

3. The electrical connector of claim 1 wherein said mating portion of the housing is elongated with ends of the housing projecting longitudinally beyond opposite ends of the mating portion, and including latch tabs on the shield for engaging latch bosses on the housing at locations longitudinally beyond said opposite ends of the mating portion.

4. The electrical connector of claim 3 wherein said latch tabs project rearwardly generally perpendicular to said flange.

5. The electrical connector of claim 1 wherein said mating portion of the housing is elongated to define long sides thereof and the shroud of said shield has long side walls covering the long sides of the mating portion, and said recess and said boss are located generally intermediate opposite ends of at least one of the long sides and the respective long side walls.

6. The electrical connector of claim 1 wherein said connector is a right-angle connector for mounting on a printed circuit board with said mating portion projecting generally parallel to the board and the terminals projecting rearwardly of the housing with right-angled tail portions of the terminals extending generally perpendicular to the board for connection to appropriate circuit traces thereon.

7. The electrical connector of claim 6 wherein said housing includes a relatively narrow portion defining a rear face opposite said front face and from which the terminals project.

8. The electrical connector of claim 7 wherein said right-angled tail portions are located in an array immediately adjacent said rear face of the housing.

9. An electrical connector, comprising:

a housing molded of dielectric material and mounting a plurality of terminals, the housing having a front face and a mating portion projecting forwardly of the front face with contact portions of the terminals located in the mating portion, the mating portion being elongated and defining long surfaces thereof;

a conductive shield of stamped and formed sheet metal material about at least a portion of the housing and including a flange abutting the front face of the housing and a shroud surrounding the elongated mating portion of the housing, the shroud having long walls covering the long surfaces of the mating portion; and complementary interengaging retaining means between the housing and the shield to properly retain the shield on the housing and including a recess in the flange intermediate opposite ends of at least one of the long walls of the shroud and a boss molded integral with the housing and projecting forwardly from the front face of the housing intermediate at least one of the long surfaces of the mating portion and into the recess in the shield.

10. The electrical connector of claim 9 wherein ends of the housing project longitudinally beyond opposite ends of the mating portion, and including latch tabs on the shield for engaging latch bosses on the housing at locations longitudinally beyond said opposite ends of the mating portion.

11. The electrical connector of claim 10 wherein said latch tabs project rearwardly generally perpendicular to said flange.

12. The electrical connector of claim 9 wherein said connector is a right-angle connector for mounting on a printed circuit board with said mating portion projecting generally parallel to the board and the terminals projecting rearwardly of the housing with right-angled tail portions of the terminals extending generally perpendicular to the board for connection to appropriate circuit traces thereon.

13. The electrical connector of claim 12 wherein said housing includes a relatively narrow portion defining a rear face opposite said front face and from which the terminals project.

14. The electrical connector of claim 13 wherein said right-angled tail portions are located in an array immediately adjacent said rear face of the housing.

15. The electrical connector of claim 9, including one of said bosses and a respective one of said recesses located intermediate each long surface of the mating portion.

16. An electrical connector, comprising:

a dielectric housing mounting a plurality of terminals, the housing having a front face and a mating portion projecting forwardly of the front face with contact portions of the terminals located on the mating portion, the mating portion being elongated and defining long surfaces thereof;

a conductive shield about at least a portion of the housing and including a flange abutting the front face of the housing and a shroud generally encircling the mating portion of the housing, the shroud having long walls covering the long surfaces of the mating portion; and complementary interengaging retaining means between the housing and the shield to properly retain the shield on the housing and including a recess in the flange of the shield intermediate opposite ends of at least one of the long walls of the shroud and a boss projecting forwardly from the front face of the housing into the recess.

17. The electrical connector of claim 16 wherein said dielectric housing is a one-piece molded structure with said boss being integral therewith.

18. The electrical connector of claim 16 wherein ends of the housing project longitudinally beyond opposite ends of the mating portion, and including latch tabs on the shield for engaging latch bosses on the housing at locations longitudinally beyond said opposite ends of the mating portion.

19. The electrical connector of claim 16 wherein said shield is a one-piece stamped and formed sheet metal structure with said recess being formed in said flange.

* * * * *